US006543793B1

(12) United States Patent
Reuss et al.

(10) Patent No.: US 6,543,793 B1
(45) Date of Patent: Apr. 8, 2003

(54) HIGHBACK FORMED OF MULTIPLE MATERIALS

(75) Inventors: Stefan Reuss, Rum (AT); David J. Dodge, Williston, VT (US); Ryan Coulter, Morristown, VT (US); Markus Koller, Inasbruck (AT); James D. Laughlin, Burlington, VT (US); Brian West, Burlington, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/677,910

(22) Filed: Oct. 3, 2000

Related U.S. Application Data

(63) Continuation of application No. 09/478,776, filed on Nov. 6, 2000, now abandoned.

(51) Int. Cl.[7] ..... A63C 9/00

(52) U.S. Cl. ..... 280/11.36; 280/14.21

(58) Field of Search ..... 280/11.36, 14.21, 280/14.24, 619, 620, 623, 624, 633, 634, 842; 36/89, 69, 117.1

(56) References Cited

U.S. PATENT DOCUMENTS

| | | | |
|---|---|---|---|
| 3,713,231 A | 1/1973 | Mochizuki | |
| 3,807,062 A | 4/1974 | Spier | |

(List continued on next page.)

FOREIGN PATENT DOCUMENTS

| | | | | |
|---|---|---|---|---|
| CA | 2071705 | | 12/1993 | |
| DE | 2 128769 | | 6/1971 | |
| DE | 27 46 980 | * | 4/1979 | ..... 280/11.36 |
| DE | 198 02 304 | * | 7/1999 | ..... A63C/9/00 |
| EP | 0 646 334 | A1 | 9/1994 | |
| EP | 0 838 248 | A1 | 4/1998 | |
| EP | 0 933 100 | A1 | 8/1999 | |
| JP | 0910830 | | 4/1997 | |
| WO | WO 85/04557 | | 10/1985 | |
| WO | WO 93/14835 | | 8/1993 | |
| WO | WO 94/07386 | | 4/1994 | |

*Primary Examiner*—Frank Vanaman
(74) *Attorney, Agent, or Firm*—Wolf, Greenfield & Sacks, P.C.

(57) ABSTRACT

A highback for controlling a gliding board, such as a snowboard, through leg movement of a rider. The highback is comprised of at least two distinct materials with different stiffnesses to achieve desired blend of stiffness and flexibility. The highback may employ a material of greater stiffness in one or more regions to provide high force transmission between the rider and the board. The highback may employ a material of lesser stiffness in one or more regions where flexibility is desired for more gradual power transmission, comfort and/or to facilitate highback adjustability. The arrangement of the different materials provides a lightweight highback with a relatively sleek profile having selected regions of stiffness and/or flexibility.

58 Claims, 5 Drawing Sheets

U.S. PATENT DOCUMENTS 3,945,135 A 3/1976 Hanson et al.
4,060,256 A 11/1977 Collombin et al.
4,154,009 A 5/1979 Kubelka et al.
4,203,235 A 5/1980 Van Pelt, Jr.
4,280,286 A 7/1981 Sartor
4,281,468 A 8/1981 Giese et al.
4,551,933 A 11/1985 Morell et al.
4,724,625 A 2/1988 Sartor
4,759,137 A 7/1988 Lederer
4,864,743 A 9/1989 Begey et al.
4,907,354 A 3/1990 Benoit et al.
5,003,710 A 4/1991 Pozzobon
5,107,609 A 4/1992 Sartor
5,174,051 A 12/1992 Walkhoff et al.
5,234,230 A 8/1993 Crane et al.
5,243,774 A 9/1993 Mattiuzzo
5,261,689 A 11/1993 Carpenter et al.
5,295,316 A 3/1994 Bergamin
5,575,091 A 11/1996 Mattiuzzo
5,606,808 A * 3/1997 Gilliard et al. ..... 36/89
5,647,148 A 7/1997 Meiselman
5,664,344 A 9/1997 Marmonier
5,690,350 A 11/1997 Turner et al.
5,690,351 A 11/1997 Karol
5,692,765 A 12/1997 Laughlin
5,713,587 A 2/1998 Morrow et al.
5,727,797 A 3/1998 Bowles
5,761,835 A 6/1998 Okajima
5,765,853 A 6/1998 Erb
5,802,741 A 9/1998 Turner et al.
5,819,440 A 10/1998 Okajima
5,832,635 A 11/1998 Finney et al.
5,875,570 A 3/1999 Sartor
5,894,684 A 4/1999 Sand et al.
5,901,469 A 5/1999 Saillet
5,906,058 A 5/1999 Rench et al.
5,909,886 A 6/1999 Tugutaka et al.
5,915,720 A 6/1999 Turner et al.
5,926,979 A 7/1999 Borel
5,941,554 A 8/1999 Bourdeau
5,966,843 A 10/1999 Sand et al.
5,967,531 A 10/1999 Saillet
6,027,136 A 2/2000 Phillips
6,099,018 A 8/2000 Maravetz et al.
6,102,429 A 8/2000 Laughlin et al.
6,116,635 A 9/2000 Rigal
6,123,342 A 9/2000 Grell
6,206,403 B1 * 3/2001 Black et al. ..... 280/620
6,231,066 B1 * 5/2001 Okajima ..... 280/623
6,273,450 B1 * 8/2001 Challande et al. ..... 280/624
6,360,454 B1 * 3/2002 Dachgruber et al. ..... 36/117.1

* cited by examiner

HIGHBACK FORMED OF MULTIPLE MATERIALS

This is a continuation of application Ser. No. 09/478,776, filed Jan. 6, 2000, now abandoned.

BACKGROUND OF THE INVENTION

1. Field of the Invention

The present invention relates generally to a highback for gliding sports, such as snowboarding, and, more particularly, to a highback formed of multiple materials having different stiffness.

2. Description of the Related Art

Snowboard binding systems for soft snowboard boots typically include an upright member, called a "highback" (also known as a "lowback" and a "skyback"), that is contacted by the rear portion of a rider's leg. The highback, which may be mounted to a binding or a boot, acts as a lever that helps transmit forces directly to and from the board, allowing the rider to efficiently control the board through leg movement. For example, flexing one's legs rearward against the highback places the board on its heel edge with a corresponding shift in weight and balance acting through the highback to complete a heelside turn.

Force transmission and, consequently, board control can be varied by highback stiffness. As the stiffness of the highback increases or decreases, force transmission increases or decreases, respectively, resulting in more or less responsive board control. A stiff highback may create undesirable pressure points against a rider's leg, rather than apply a uniform pressure distribution across the boot and leg. For example, the upper portion of a stiff highback may engage the rider's calf muscle, thereby concentrating much of the force between the highback and the rider's leg onto the calf muscle, a condition riders generally find uncomfortable.

Snowboard bindings typically are mounted to a snowboard to allow the rider to select a desired stance angle of the binding relative to the board. Specifically, the angle between the midline of the binding and the midline of the snowboard can be altered for different riding styles, such as trick riding, backcountry riding or simple traveling, and for different riding preferences. Once the desired stance angle is set, a rider may wish to reposition the highback, whether mounted to a binding or to a boot, so that the highback is generally aligned with the heel-edge of the board to enhance force transmission during a heel-side turn. This may be accomplished by mounting the highback for lateral rotation about a substantially vertical axis. A stiff highback generally is more limited, as compared to a more flexible highback, in terms of the extent and the ease by which it can be laterally rotated to a desired position.

Known highbacks are typically molded from either a composite material or a plastic material. A highback formed from a composite material, while sleek and lightweight, is generally very stiff. In contrast, a highback formed from a more flexible plastic material generally is bulky and relatively heavy due to structural features typically molded into the highback that provide the necessary stiffness for force transmission.

It is an object of the present invention to provide an improved highback having a blend of stiffness and flexibility.

SUMMARY OF THE INVENTION

In one illustrative embodiment of the invention, a highback is provided for use with a component, such as a gliding board binding, a boot or a binding interface, that interfaces with a rider's leg and is supportable by a gliding board. The highback comprises an upright support member constructed and arranged to be contacted by and to support a rear portion of the rider's leg, and a pair of mounting locations integrally formed with the support member and being disposed on opposing sides of the lower portion thereof for mounting the highback to the gliding board component. The support member includes a lower portion and an upper portion, the support member being comprised of at least a first material having a first stiffness extending continuously from an upper end of the upper portion to at least a lower end of the upper portion. The mounting locations are comprised of a second material that is different from the first material and has a second stiffness that is different from the first stiffness.

In another illustrative embodiment of the invention, the highback comprises an upright support member including an upper portion and a heel cup integrally formed with the upper portion. The upper portion is constructed and arranged to be contacted by and to support a rear portion of the rider's leg. The heel cup is configured to hold a heel portion of a boot. The upper portion is comprised of a first material and the heel cup is comprised substantially of a second material that is different from the first material. The first material has a first stiffness and the second material has a second stiffness that is less than the first stiffness.

In a further illustrative embodiment of the invention, a snowboard binding is provided for securing a snowboard boot to a snowboard. The snowboard binding comprises a baseplate that is mountable to the snowboard, a heel hoop disposed at a heel end of the baseplate and a highback pivotally supported by the baseplate adjacent the heel hoop. The highback is constructed and arranged to be contacted by and to support a rear portion of a rider's leg. The highback includes an upper region that cooperates with the heel hoop to transmit forces between the rider's leg and the snowboard, and a lower region integrally formed with the upper region and pivotally mounted to the baseplate. The upper region is comprised of a first material and the lower region is comprised of a second material that is different from the first material. The first material has a first stiffness and the second material has a second stiffness that is less than the first stiffness.

Various embodiments of the present invention provide certain advantages. Not all embodiments of the invention share the same advantages and those that do may not share them under all circumstances. This being said, the present invention provides numerous advantages including the noted advantage of providing an improved highback.

BRIEF DESCRIPTION OF THE DRAWINGS

The invention will be appreciated more fully with reference to the following detailed description of illustrative embodiments thereof, when taken in conjunction with the accompanying drawings, wherein like reference characters denote like features, in which.

DETAILED DESCRIPTION

Figure 1:
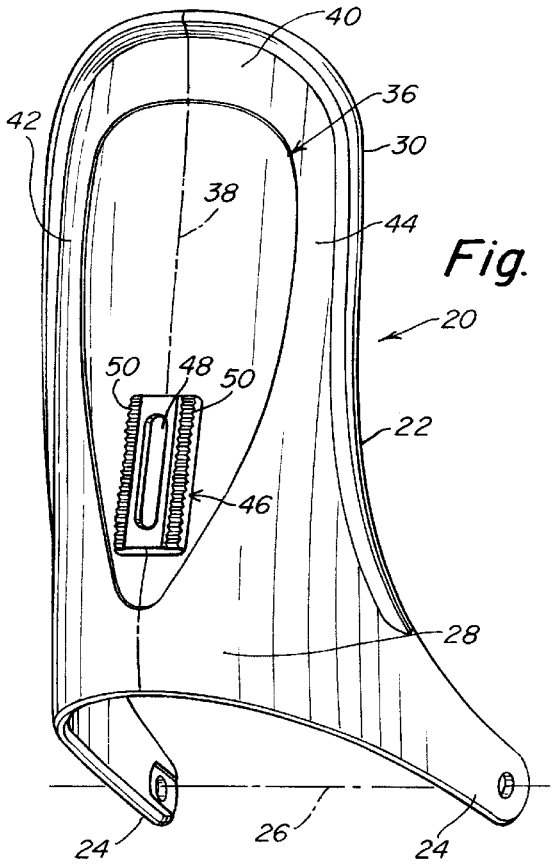
FIG. 1 is a rear perspective view of the highback according to one illustrative embodiment of the invention.
Figure 2:
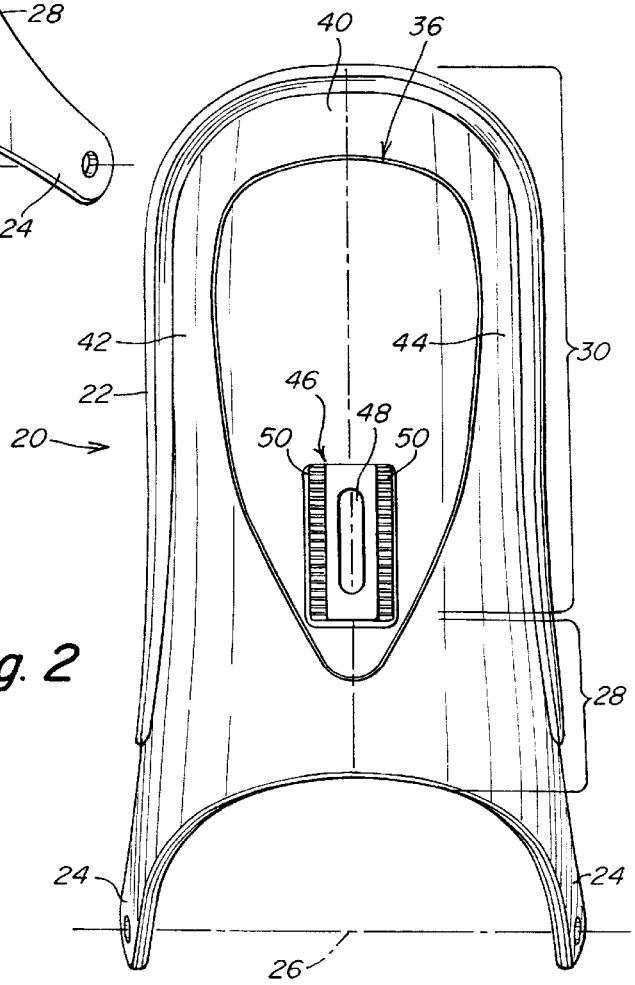
FIG. 2 is a rear view of the highback of FIG. 1.
Figure 3:
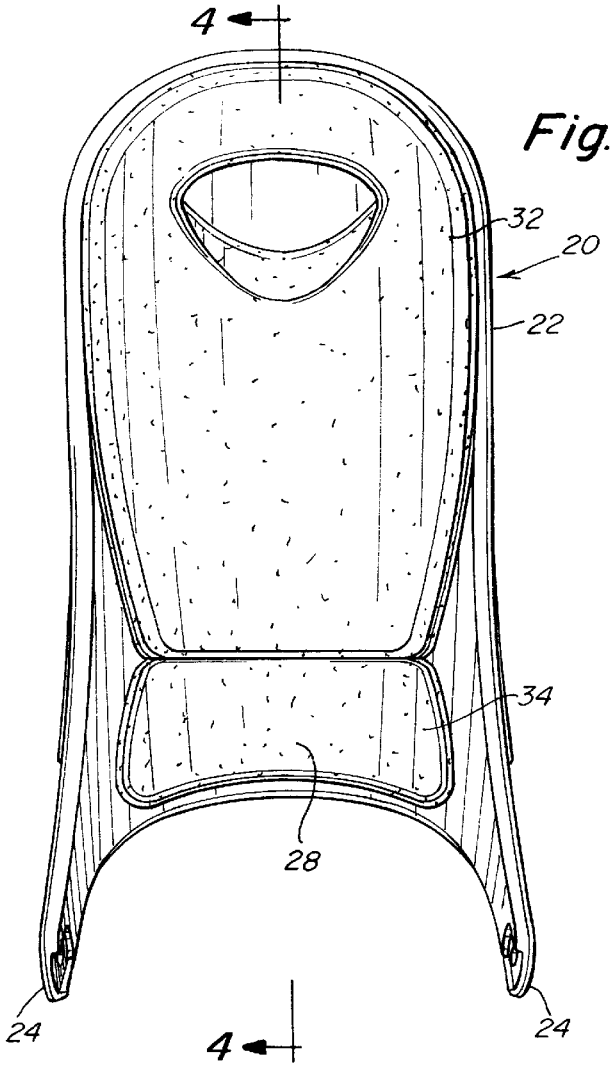
FIG. 3 is a front view of the highback of FIG. 1.
Figure 4:
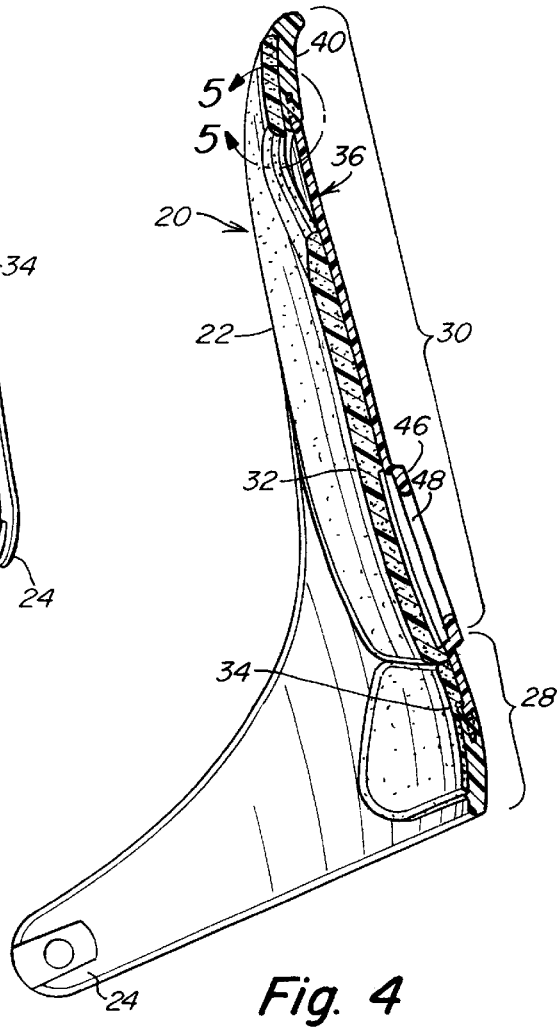
FIG. 4 is a cross-sectional view taken along section line 4—4 of FIG. 3.
Figure 5:
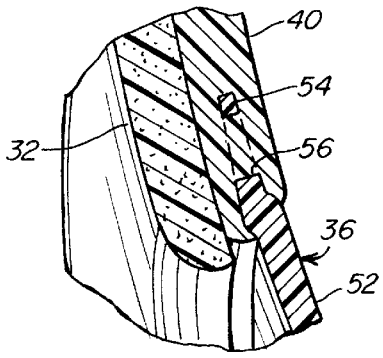
FIG. 5 is an enlarged fragmented view of a portion of FIG. 4 illustrating one embodiment of the connection between the cassette and the support member of the highback.

The present invention is directed to a highback, for use with a gliding board component, comprised of at least two distinct materials with different stiffnesses to achieve a desired blend of stiffness and flexibility. The highback may employ a material of greater stiffness in one or more regions to provide high force transmission between the rider and the board. The highback may employ a material of lesser stiffness in one or more regions where flexibility is desired for more gradual power transmission, comfort and/or to facilitate highback adjustability. The arrangement of the different materials provides a lightweight highback with a relatively sleek profile having selected regions of stiffness and/or flexibility.

The highback may be formed with a first material of relatively high stiffness extending along its vertical spine to provide a rigid region for transmitting forces between the rider and the board. The highback may also include one or more other materials of lesser stiffness in selected regions about the first material to reduce pressure points between the highback and the leg, particularly the rider's calf muscle, for increased comfort while maintaining heelside support for board control. A less stiff material may also be provided in selected regions of the highback for enhancing flexibility, such as may be desirable for lateral rotation of the highback and pivoting of the highback into a collapsed or storage configuration to provide a reduced profile, such as when the board is carried on a roof rack.

In one illustrative embodiment as shown in FIGS. 1–5, the highback 20 includes an upright support member 22 and a pair of lateral ears 24 disposed on opposing sides of the support member. The lateral ears 24 provide mounting locations that may be employed to pivotally attach the highback to a gliding board component, such as a snowboard binding, a snowboard boot or a binding interface, along a mounting axis 26 that is transverse to the length of the binding or boot. The lateral ears 24 may be configured to have any shape suitable with the particular mounting arrangement for the highback.

The support member 22 preferably has a contoured configuration that is compatible with the shape of a boot. The highback 20 includes a heel cup 28 in a lower portion of the support member 22 that is configured to grip and hold the heel portion of the boot. The support member 22 transitions from the heel cup 28 to an upper portion 30 of the highback that is configured to extend along and to be contacted by the rear portion of the rider's leg to provide heelside support for turning and controlling the board. The inner surface of the highback may include one or more resilient pads 32, 34 to increase heel hold, to absorb shock and to facilitate pressure distribution across the boot and leg.

In one illustrative embodiment of the invention, the highback 20 includes a first region 36 comprised of a first material extending along at least a portion of the spine 38 of the support member 22. The first material has a relatively high stiffness to provide the support member 22 with sufficient rigidity to transmit forces between the rider's leg and the board. The first material extends continuously from an upper end of the upper portion 30 to at least a lower end of the upper portion that will engage with the gliding board component. As illustrated, the first material may also extend into a portion of the heel cup 28 to create a beam effect along substantially the entire spine 38 of the support member.

While a high degree of rigidity may be desirable in the upper portion 30 of the support member to ensure force transmission, more flexibility is generally preferred in the lower regions of the highback, for example, to facilitate lateral rotation of the highback on the snowboard component for accommodating a particular binding stance angle. In the illustrative embodiment, the lateral ears 24 are comprised of a second material having a stiffness that is less than the stiffness of the first material. The flexibility through the lower portion of the highback is further enhanced with a substantial portion of the heel cup 28 also being comprised of the second material.

It is to be appreciated, however, that the heel cup 28 may be formed from one or more other materials having a stiffness that is different from both the first and second materials. For example, the heel cup 28 may be formed of a material having a stiffness that is less than the first material and either greater than or less than the second material.

The first region 36 is bordered by an upper margin 40 and opposing side margins 42, 44 that extend from the upper margin 40 to the heel cup 28. In the illustrative embodiment, the upper and side margins 40, 42, 44 are formed from the second material. Surrounding the first region 36 with a more flexible material is conducive to providing gradual force transmission between the rider and the board. A more flexible upper margin 40 also reduces a potential pressure point between the upper edge of the highback and the rider's leg.

It is to be appreciated that the more flexible second material may terminate prior to the upper and/or side margins 40, 42, 44. The highback 20 may even be configured without one or more of the upper and side margins 40, 42, 44 of the second material to achieve any desirable highback configuration. Further, one or more of the upper and side margins 40, 42, 44 may be formed from any suitable material or combination of materials having a particular stiffness, including the first and second materials or any other suitable material, as would be apparent to one of skill.

The first region 36 of material may be shaped in any suitable configuration for providing a desired overall stiffness along the support member. In the illustrative embodiment, the first region 36 is shaped with an inverted tear drop or oar blade configuration. This particular configuration provides the support member with a high degree of stiffness across the upper portion 30. The stiffness of the support member 22 gradually decreases in a direction toward the heel cup 28, where more flexibility is generally desired, as the width of the region 36 decreases. The particular shape of the region 36, however, is not limited to this configuration and other shapes are contemplated to achieve any desired localized stiffness or overall stiffness profile. For example, the first material may be provided in two or more distinct regions that extend along portions of the upper portion and are spaced across the width of the support member.

A snowboard rider's leg is generally held by the highback at a forward angle relative to the board for balance, control and to ensure the rider's knee is bent for better shock absorption, particularly when landing jumps. To hold the rider's leg in such a stance, the highback is typically inclined relative to the board in a position referred to as "forward lean". The highback may be mounted to the snowboard component for rotation in the heel-to-toe direction and, therefore, the rider may selectively adjust the forward lean angle of the highback relative to the board for comfort, control and the rider's particular riding style.

In one illustrative embodiment, the highback 20 includes a forward lean adjuster mount 46 that is configured to receive a suitable forward lean adjuster for setting the forward lean of the highback. The mount 46 is supported by the first region 36 of material to ensure direct transmission of force from the highback to the board. As shown, the mount 46 is integrally formed of the first material along the spine 38 of the support member 22 at the lower end of the upper portion 30 above the heel cup 28.

The forward lean adjuster mount 46 may be provided with an adjustment feature that is adapted to adjustably support a forward lean adjuster. In one embodiment, the mount 46 is provided with an elongated slot 48 along which the forward lean adjuster may positioned to set the forward lean of the highback. The mount 46, however, may be provided with any suitable structure or feature, such as a series of spaced holes, rather than or perhaps in conjunction with the slot to facilitate adjustment of the forward lean adjuster.

The forward lean adjuster mount 46 may also be provided with a plurality of locking elements 50 along the length of the mount to engage and maintain the forward lean adjuster in a desired forward lean position. In one embodiment, the locking elements 50 include a rack of teeth extending along each side of the slot 48. It is to be appreciated, however, that the locking elements 50 may include any suitable structure or feature, such as pins, holes and the like, for engaging with the forward lean adjuster.

Figure 6:
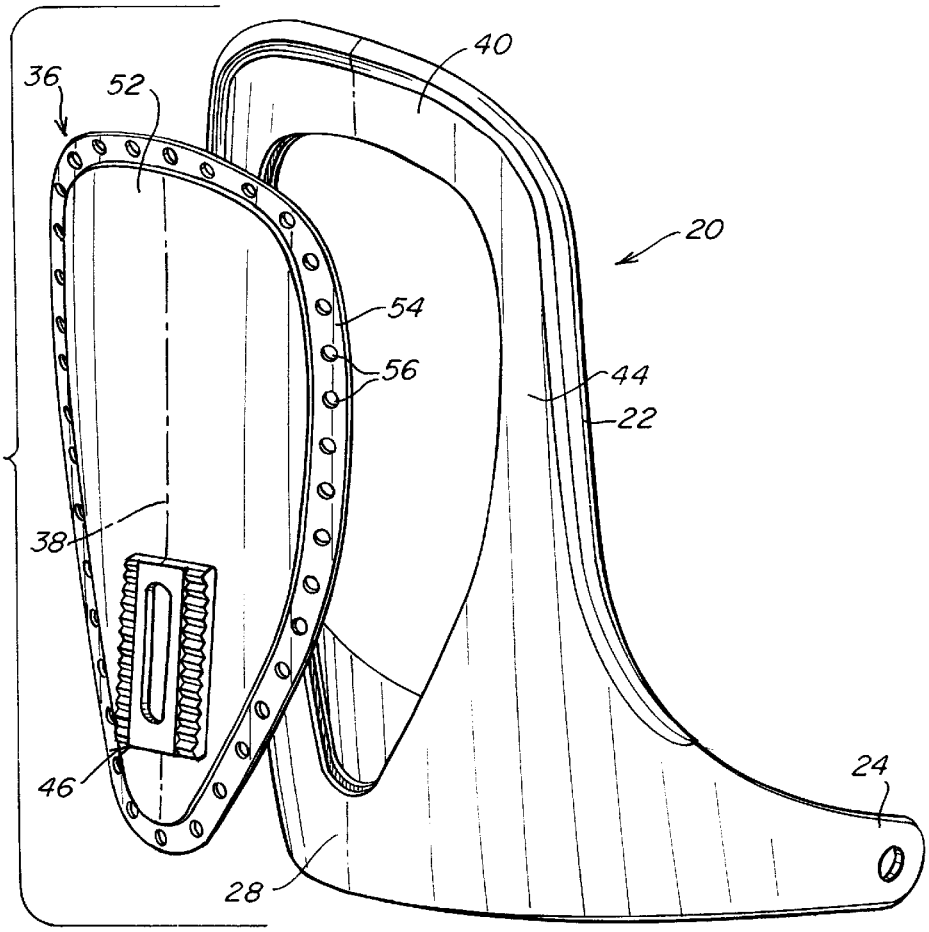
FIG. 6 is an exploded view of the highback of FIG. 1.

The highback 20 may be constructed using any suitable manufacturing techniques as would be apparent to one of skill in the art for combining two or more materials into a unitary structure. In one illustrative embodiment shown in FIGS. 6–7, the first region 36 is fabricated as a separate part, which may be referred to hereinafter as a cassette, that is joined to the support member 22 of the highback. The cassette 36 includes a body portion 52 and a peripheral flange 54 that extends from and circumscribes the body portion. The flange 54 is configured to connect the cassette 36 to the support member 22. As shown, the flange 54 may be provided with a plurality of holes 56 that facilitate the connection between the cassette and the support member.

Figure 7:
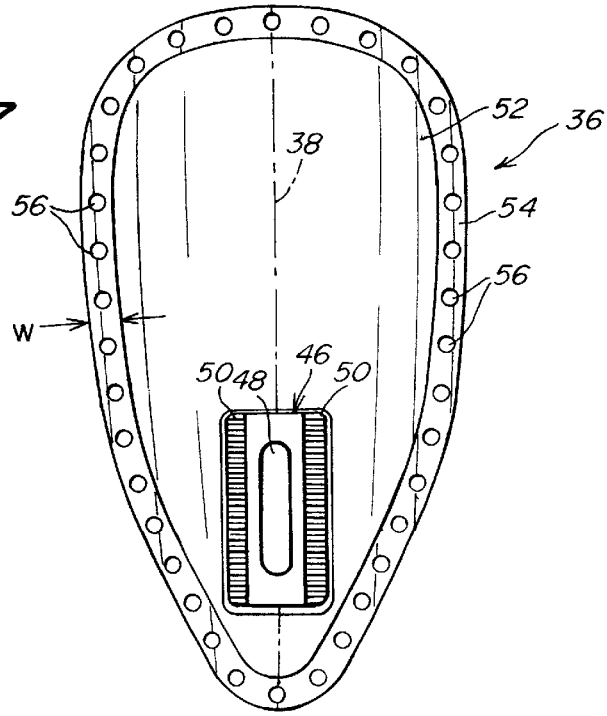
FIG. 7 is a rear view of one embodiment of the cassette employed with the highback of FIG. 1.

The cassette 36 may be over-molded with the second material to integrally form the overall highback structure. As shown in FIG. 7, the flange 54 of the cassette is encapsulated from both sides to capture the flange within the support member 22 and create a unitary structure capable of withstanding a wide range of forces applied to the highback. The flange 54 lies in a plane offset from the body portion 52 so that the rear surface of the cassette is generally flush with the rear surface of the support member. The plurality of holes 56 in the flange 54 are filled with the second material to create a positive mechanical joint between the cassette 36 and the support member 22 to reduce separation between the components. In one embodiment, the flange 54 has a width W of approximately 6 mm to establish the connection between the cassette and the support member.

It is to be appreciated that the cassette 36 may employ any suitable flange configuration apparent to one of skill. For example, the flange 54 may be formed with holes of various shapes, including circular, rectangular, oblong and the like. The flange 54 may be provided without holes and/or include teeth or other suitable features to enhance the connection between the cassette and the support member. The flange may also be formed by a plurality of individual extensions spaced about the periphery of the body portion 52.

The cassette 36 may be comprised of a lightweight, stiff composite material that provides the desired stiffness along the support member 22 without the bulk associated with less stiff plastic materials. In one embodiment, the cassette 36 is formed from a sheet of a thermoplastic composite including woven glass or carbon fabric layers combined with a nylon resin. The composite material is compression molded to form the desired configuration of the cassette, including one or more of the structural features described above or any other desired structure. One example of a suitable composite material includes TEPEX Flowcore available from Bond-Laminates of Trossingen, Germany. In one embodiment, the cassette 36 is compression molded from a sheet of material having a thickness of approximately 2 mm. Other suitable materials may include fiber-reinforced plastics, such as CELSTRAN and the like.

The remaining structure of the highback, including the lateral ears 24, heel cup 28 and the upper and side margins 40, 42, 44, may be formed of a less stiff, more flexible plastic material. In one embodiment, a nylon material is molded about the cassette 36, such as by injection molding. In addition to the mechanical connection formed between the cassette and the support member, the use of compatible materials, such as a nylon resin composite and a nylon over-mold material, may create a chemical bond between the materials to further unitize the overall structure of the highback. To enhance such a chemical bond between the materials, the over-molding process may be performed soon after the cassette has been compression molded and while it is still warm as would be apparent to one of skill.

Although the cassette 36 may be molded within the support member 22, it is to be appreciated that any suitable fastening scheme may be implemented to attach the cassette to the support member. For example, the cassette 36 may be attached to a preformed support member 22 using any suitable fasteners, such as screws, rivets and the like, as would be apparent to one of skill. Alternatively, or in conjunction with mechanical fasteners, the cassette may be bonded to the support member using a suitable adhesive.

It is to be appreciated that the highback 20 may be formed with any suitable combination of composite and plastic materials, including polyurethane, polyolefin and the like. It is also contemplated that the cassette 36 may be formed from a relatively stiff non-composite plastic material, such as a polyolefin, that is over-molded with a more flexible plastic, such as a polyurethane.

In another illustrative embodiment of the invention, the stiffness of the highback 20 may be adjusted using a plurality of interchangeable cassettes 36, each comprised of a material having a stiffness that differs from the other cassettes. The cassettes 36 may also be provided with different shapes to vary the overall stiffness of the cassettes as would be apparent to one of skill. The cassettes 36 may be removably attached to the support member, such as with removable fasteners, to allow easy replacement thereof.

The highback 20 according to the present invention may be employed in any gliding board activity, such as snowboarding, that would benefit from heelside support. For ease of understanding, however, and without limiting the scope of the invention, the inventive highback is now described below in connection with a snowboard binding.

Figure 8:
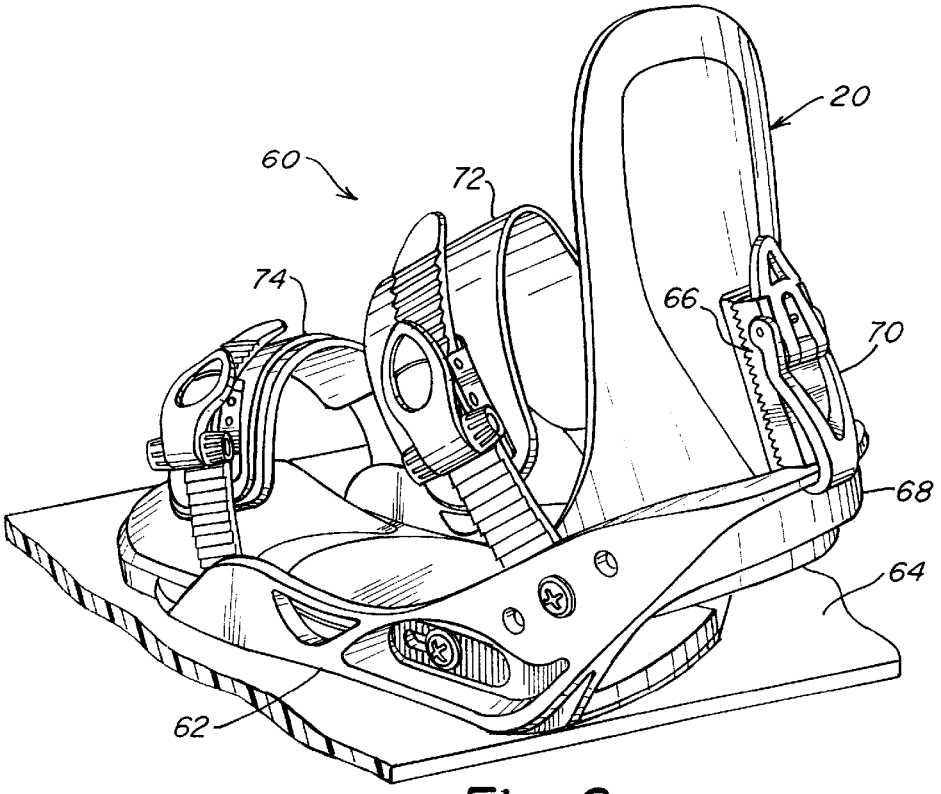
FIG. 8 is a side view of the highback incorporated with an illustrative embodiment of a snowboard binding according to another aspect of the invention.

In an illustrative embodiment shown in FIG. 8, the snowboard binding 60 may include a baseplate 62, which is mountable to a snowboard 64, and one or more binding straps, preferably adjustable straps, that are attached to the baseplate for securing a boot (not shown) to the snowboard. The highback 20 is pivotally mounted to the sidewalls of the baseplate 62. A forward lean adjuster 66 may be mounted to the highback to interact with a heel hoop 68 for setting the highback 20 at a preselected forward lean angle relative to the board. A lockdown feature 70, such as a latch, may be provided to lock down the highback 20 to the heel hoop 68 for enhanced toeside response.

As illustrated, the binding 60 may include an ankle strap 72 that extends across the ankle portion of the boot to hold down the rider's heel and a toe strap 74 that extends across and holds down the front portion of the boot. It is to be understood, however, that the binding 60 may employ other strap configurations.

The highback 20 of the present invention, however, is not limited to any particular type of binding. For example, the highback may also be implemented with a step-in snowboard binding that includes a locking mechanism that engages corresponding features provided, either directly or indirectly, on a snowboard boot. The highback may be mounted to a binding baseplate in a manner similar to the binding described above. Examples of step-in snowboard bindings that may incorporate the highback are described in U.S. Pat. No. 5,722,680 and U.S. patent application Ser. No. 08/780,721, which are incorporated herein by reference.

Figure 9:
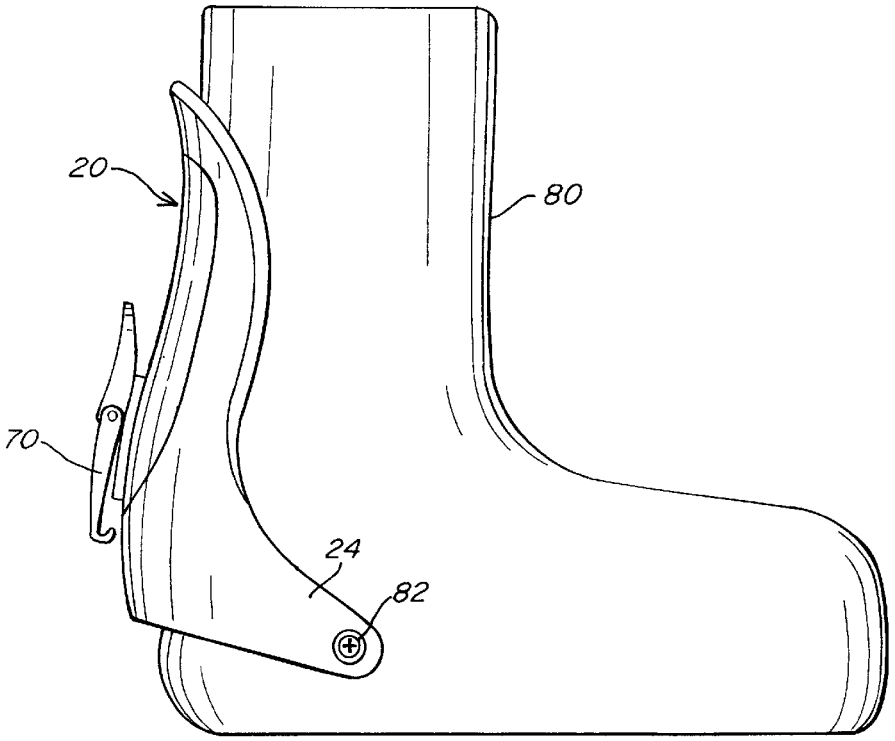
FIG. 9 is a side view of the highback incorporated with an illustrative embodiment of a snowboard boot system according to a further aspect of the invention.

In another embodiment, the highback 20 of the present invention may be either permanently attached to or removable from a snowboard boot. A removable highback provides system flexibility by allowing the boot to be implemented with binding systems that already include a highback mounted to a binding baseplate. As illustrated in FIG. 9, the highback 20 is movably mounted to the heel region of a boot 80. The lateral ears 24 are preferably attached below the ankle portion of the boot for facilitating lateral or side-to-side boot flexibility that allows desirable lateral foot roll. The lateral ears 24 may be attached to the boot, preferably at reinforced attachment points, using any suitable fastener 82, such as a screw, rivet or the like, that passes through each lateral ear.

In another aspect of the invention, the highback 20 may be implemented with a detachable binding interface system for interfacing a boot to a binding. As illustrated in one embodiment shown in FIG. 10, the interface 90 includes a body 92 and at least one adjustable strap 94 that is arranged to be disposed across the ankle portion of the boot 96, which is shown in phantom. The highback 20 is movably mounted to the sidewalls of the interface body 92 using a suitable fastener 95 that passes through the lateral ears 24 of the highback. The body 92 of the interface may include one or more mating features 98, as would be apparent to one of skill in the art, that are adapted to engage corresponding engagement members 100 on the binding 102.

Figure 10:
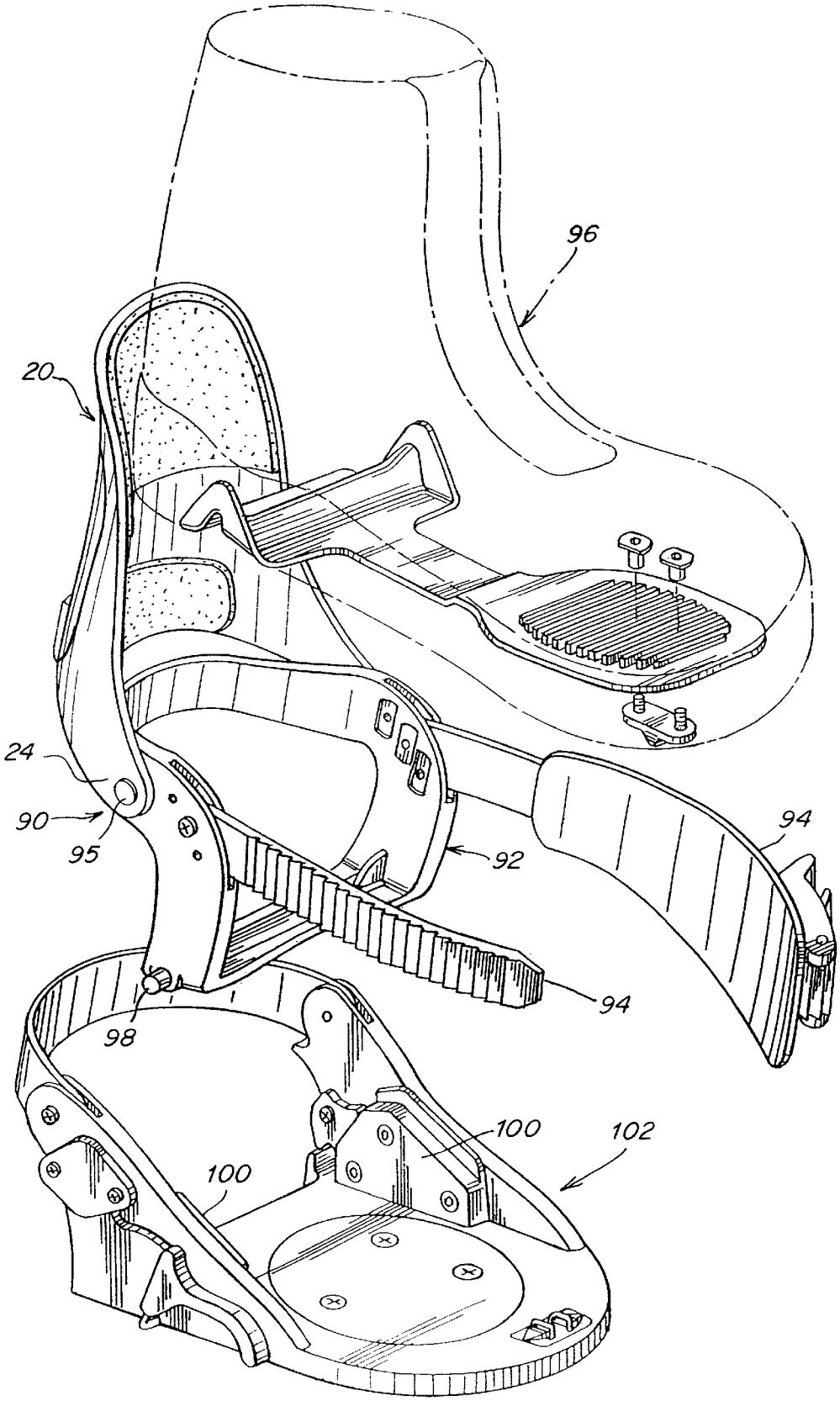
FIG. 10 is a perspective view of the highback incorporated with an illustrative embodiment of a detachable binding interface according to another aspect of the invention.

The particular binding interface 90 and binding 102 shown in FIG. 10 is described in greater detail in a U.S. application Ser. No. 09/062,131, which is incorporated herein by reference.

For ease of understanding, and without limiting the scope of the invention, the inventive highback to which this patent is addressed has been discussed particularly in connection with a boot or binding that is used in conjunction with a snowboard. It should be appreciated, however, that the present invention may be used in association with other types of gliding boards. Thus, for purposes of this patent, "gliding board" refers generally to specially configured boards for gliding along a terrain such as snowboards, snow skis, water skis, wake boards, surf boards and other board-type devices which allow a rider to traverse a surface.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A highback for use with a gliding board component that interfaces with a rider's leg and is supportable by a gliding board, the highback comprising:

an upright support member constructed and arranged to be contacted by and to support a rear portion of the rider's leg, the support member including a lower portion and an upper portion, the support member being comprised of at least a first material having a first stiffness extending continuously from an upper end of the upper portion to at least a lower end of the upper portion; and a pair of mounting locations integrally formed with the support member and being disposed on opposing sides of the lower portion thereof for mounting the highback to the gliding board component, the mounting locations being comprised of a second material that is different from the first material and has a second stiffness that is different from the first stiffness;

wherein the first stiffness is greater than the second stiffness, the lower portion includes a heel cup configured to hold a heel portion of a boot, the heel cup being comprised substantially of the second material, and wherein the support member includes an upper margin along the upper end of the upper portion thereof comprised of a material that is different from the first material and has a stiffness that is less than the first stiffness.

2. The highback according to claim 1, wherein the support member further includes opposing side margins along the upper portion thereof comprised of a material that is different from the first material.

3. The highback according to claim 2, wherein the side margins extend from the upper margin to the heel cup.

4. The highback according to claim 3, wherein at least one of the upper margin and the side margins is comprised of the second material.

5. The highback according to claim 4, wherein each of the upper margin and the side margins is comprised of the second material.

6. The highback according to claim 1, wherein the first material extends into a portion of the heel cup.

7. The highback according to claim 1, wherein the support member has a contoured configuration that is compatible with the rear portion of the rider's leg.

8. The highback according to claim 1, wherein the support member includes a spine extending along the length thereof, the first material extending along a substantial portion of the spine of the support member.

9. The highback according to claim 1, wherein the first material forms a cassette that is supported on the support member.

10. The highback according to claim 9, wherein the cassette includes a body portion and a peripheral flange extending from the body portion, the flange being attached to the support member to connect the cassette thereto.

11. The highback according to claim 1, further comprising a pair of lateral ears supported on the opposing sides of the lower portion, the mounting locations being disposed on the lateral ears.

12. The highback recited in claim 1, wherein the gliding board is a snowboard and the component is a snowboard component.

13. The highback recited in claim 12, in combination with the snowboard component, the highback being mounted on the snowboard component.

14. The combination recited in claim 13, wherein the snowboard component includes a snowboard binding having a baseplate, the highback being pivotally mounted to the baseplate.

15. The combination recited in claim 14, wherein the snowboard binding includes at least one adjustable strap mounted to the baseplate to secure a snowboard boot.

16. The combination recited in claim 14, wherein the snowboard binding is a step-in binding.

17. The combination recited in claim 13, wherein the snowboard component includes a snowboard boot, the highback being pivotally mounted to the snowboard boot.

18. The combination recited in claim 13, wherein the snowboard component includes a detachable binding interface that is constructed and arranged to interface a snowboard boot with a snowboard binding.

19. A highback for use with a gliding board component that interfaces with a rider's leg and is supportable by a gliding board, the highback comprising:

an upright support member constructed and arranged to be contacted by and to support a rear portion of the rider's leg, the support member including a lower portion and an upper portion, the support member being comprised of at least a first material having a first stiffness extending continuously from an upper end of the upper portion to at least a lower end of the upper portion;

a pair of mounting locations integrally formed with the support member and being disposed on opposing sides of the lower portion thereof for mounting the highback to the gliding board component, the mounting locations being comprised of a second material that is different from the first material and has a second stiffness that is different from the first stiffness, wherein the first stiffness is greater than the second stiffness; and a forward lean actuator mount that is constructed and arranged to support a forward lean actuator thereon, the forward lean actuator mount being disposed on the first material at the lower end of the upper portion.

20. The highback according to claim 19, wherein the forward lean actuator mount is integrally formed with the first material.

21. A highback for use with a gliding board component that interfaces with a rider's leg and is supportable by a gliding board, the highback comprising:

an upright support member constructed and arranged to be contacted by and to support a rear portion of the rider's leg, the support member including a lower portion and an upper portion, the support member being comprised of at least a first material having a first stiffness extending continuously from an upper end of the upper portion to at least a lower end of the upper portion; and a pair of mounting locations integrally formed with the support member and being disposed on opposing sides of the lower portion thereof for mounting the highback to the gliding board component, the mounting locations being comprised of a second material that is different from the first material and has a second stiffness that is different from the first stiffness;

wherein the first material forms a cassette that is supported on the support member, wherein the cassette includes a body portion and a peripheral flange extending from the body portion, the flange being attached to the support member to connect the cassette thereto, and wherein the support member is molded to the flange.

22. The highback according to claim 21, wherein the flange has a plurality of holes that receive a portion of the support member therethrough.

23. A highback for use with a gliding board component that interfaces with a rider's leg and is supportable by a gliding board, the highback comprising:

an upright support member constructed and arranged to be contacted by and to support a rear portion of the rider's leg, the support member including a lower portion and an upper portion, the support member being comprised of at least a first material having a first stiffness extending continuously from an upper end of the upper portion to at least a lower end of the upper portion; and a pair of mounting locations integrally formed with the support member and being disposed on opposing sides of the lower portion thereof for mounting the highback to the gliding board component, the mounting locations being comprised of a second material that is different from the first material and has a second stiffness that is different from the first stiffness, wherein the first material is a composite and the second material is a plastic material that is molded to the composite.

24. A highback for use with a gliding board component that interfaces with a rider's leg and is supportable by a gliding board, the highback comprising:

an upright support member including an upper portion and a heel cup integrally formed with the upper portion, the upper portion being constructed and arranged to be contacted by and to support a rear portion of the rider's leg, the heel cup being configured to hold a heel portion of a boot, the upper portion being comprised of a first material and the heel cup being comprised substantially of a second material that is different from the first material, the first material having a first stiffness and the second material having a second stiffness that is less than the first stiffness;

wherein the support member includes an upper margin along the upper end of the upper portion thereof comprised of a material that is different from the first material and has a stiffness that is less than the first stiffness.

25. The highback according to claim 24, wherein the support member further includes opposing side margins along the upper portion thereof comprised of a material that is different from the first material.

26. The highback according to claim 25, wherein the side margins extend from the upper margin to the heel cup.

27. The highback according to claim 26, wherein at least one of the upper margin and the side margins is comprised of the second material.

28. The highback according to claim 27, wherein each of the upper margin and the side margins is comprised of the second material.

29. The highback according to claim 24, wherein the first material extends into a portion of the heel cup.

30. The highback according to claim 24, wherein the support member has a contoured configuration that is compatible with the rear portion of the rider's leg.

31. The highback according to claim 24, wherein the support member includes a spine extending along the length thereof, the first material extending along a substantial portion of the spine of the support member.

32. The highback according to claim 24, wherein the first material forms a cassette that is supported on the support member.

33.The highback according to claim 32, wherein the cassette includes a body portion and a peripheral flange extending from the body portion, the flange being attached to the support member to connect the cassette thereto.

34. The highback according to claim 24, further comprising a pair of lateral ears supported on the opposing sides of the heel cup, wherein each lateral ear includes a mounting location adapted to mount the highback to the gliding board component.

35. The highback recited in claim 24, wherein the gliding board is a snowboard and the component is a snowboard component.

36. The highback recited in claim 33, in combination with the snowboard component, the highback being mounted on the snowboard component.

37. The combination recited in claim 36, wherein the snowboard component includes a snowboard binding having a baseplate, the highback being pivotally mounted to the baseplate.

38. The combination recited in claim 37, wherein the snowboard binding includes at least one adjustable strap mounted to the baseplate to secure a snowboard boot.

39. The combination recited in claim 37, wherein the snowboard binding is a step-in binding.

40. The combination recited in claim 36, wherein the snowboard component includes a snowboard boot, the highback being pivotally mounted to the snowboard boot.

41. The combination recited in claim 36, wherein the snowboard component includes a detachable binding interface that is constructed and arranged to interface a snowboard boot with a snowboard binding.

42. A highback for use with a gliding board component that interfaces with a rider's leg and is supportable by a gliding board, the highback comprising:

an upright support member including an upper portion and a heel cup integrally formed with the upper portion, the upper portion being constructed and arranged to be contacted by and to support a rear portion of the rider's leg, the heel cup being configured to hold a heel portion of a boot, the upper portion being comprised of a first material and the heel cup being comprised substantially of a second material that is different from the first material, the first material having a first stiffness and the second material having a second stiffness that is less than the first stiffness; and a forward lean actuator mount that is constructed and arranged to support a forward lean actuator thereon, the forward lean actuator mount being disposed on the first material at the lower end of the upper portion.

43. The highback according to claim 42, wherein the forward lean actuator mount is integrally formed with the first material.

44. A highback for use with a gliding board component that interfaces with a rider's leg and is supportable by a gliding board, the highback comprising:

an upright support member including an upper portion and a heel cup integrally formed with the upper portion, the upper portion being constructed and arranged to be contacted by and to support a rear portion of the rider's leg, the heel cup being configured to hold a heel portion of a boot, the upper portion being comprised of a first material and the heel cup being comprised substantially of a second material that is different from the first material, the first material having a first stiffness and the second material having a second stiffness that is less than the first stiffness;

wherein the first material forms a cassette that is supported on the support member, wherein the cassette includes a body portion and a peripheral flange extending from the body portion, the flange being attached to the support member to connect the cassette thereto, and wherein the support member is molded to the flange.

45. The highback according to claim 44, wherein the flange has a plurality of holes that receive a portion of the support member therethrough.

46. A highback for use with a gliding board component that interfaces with a rider's leg and is supportable by a gliding board, the highback comprising:

an upright support member including an upper portion and a heel cup integrally formed with the upper portion, the upper portion being constructed and arranged to be contacted by and to support a rear portion of the rider's leg, the heel cup being configured to hold a heel portion of a boot, the upper portion being comprised of a first material and the heel cup being comprised substantially of a second material that is different from the first material, the first material having a first stiffness and the second material having a second stiffness that is less than the first stiffness, wherein the first material is a composite and the second material is a plastic material that is molded to the composite.

47. A snowboard binding for securing a snowboard boot to a snowboard, the snowboard binding comprising:

a baseplate that is mountable to the snowboard;

a heel hoop disposed at a heel end of the baseplate; and a highback pivotally supported by the baseplate adjacent the heel hoop, the highback being constructed and arranged to be contacted by and to support a rear portion of a rider's leg, the highback including:

an upper region that cooperates with the heel hoop to transmit forces between the rider's leg and the snowboard, the upper region being comprised of a first material having a first stiffness; and a lower region integrally formed with the upper region, the lower region being pivotally mounted to the baseplate, the lower region being comprised of a second material that is different from the first material and having a second stiffness that is less than the first stiffness;

wherein the upper region includes an upper margin along the upper end thereof comprised of a material that is different from the first material and has a stiffness that is less than the first stiffness.

48. The snowboard binding according to claim 47, wherein the lower region includes a heel cup configured to hold a heel portion of the snowboard boot, the heel cup being substantially comprised of the second material.

49. The snowboard binding according to claim 48, wherein the lower region includes a pair of mounting locations disposed on opposing sides of the heel cup, the mounting locations being comprised of the second material.

50. The snowboard binding according to claim 49, wherein the lower region includes a pair of lateral ears supported on the opposing sides of the heel cup, the lateral ears being comprised of the second material, the mounting locations being disposed on the lateral ears.

51. The snowboard binding according to claim 50, wherein the first material extends into a portion of the heel cup.

52. The snowboard binding according to claim 47, wherein the lower region includes a pair of mounting locations that are pivotally mounted to the baseplate, the mounting locations being comprised of the second material.

53. The snowboard binding according to claim 47, wherein the highback is mounted to the baseplate for lateral rotation about a vertical axis.

54. The snowboard binding according to claim 47, wherein the upper region further includes opposing side margins comprised of a material that is different from the first material.

55. The snowboard binding according to claim 54, wherein the side margins extend from the upper margin to the lower region.

56. The snowboard binding according to claim 55, wherein at least one of the upper margin and the side margins is comprised of the second material.

57. The snowboard binding according to claim 56, wherein each of the upper margin and the side margins is comprised of the second material.

58. A snowboard binding for securing a snowboard boot to a snowboard, the snowboard binding comprising:

a baseplate that is mountable to the snowboard;

a heel hoop disposed at a heel end of the baseplate; and a highback pivotally supported by the baseplate adjacent the heel hoop, the highback being constructed and arranged to be contacted by and to support a rear portion of a rider's leg, the highback including:

an upper region that cooperates with the heel hoop to transmit forces between the rider's leg and the snowboard, the upper region being comprised of a first material having a first stiffness;

a lower region integrally formed with the upper region, the lower region being pivotally mounted to the baseplate, the lower region being comprised of a second material that is different from the first material and having a second stiffness that is less than the first stiffness; and a forward lean adjuster mounted on a lower end of the upper region to engage the heel hoop.

* * * * *

UNITED STATES PATENT AND TRADEMARK OFFICE

CERTIFICATE OF CORRECTION

PATENT NO. : 6,543,793 B1
DATED : April 8, 2003
INVENTOR(S) : Reuss et al.

It is certified that error appears in the above-identified patent and that said Letters Patent is hereby corrected as shown below:

Title page,
Item [63], should read as follows:
-- [63] Continuation of application No. 09/478,776, filed on Jan. 6, 2000, now abandoned. --

Item [75], should read as follows:
-- [75] Inventors: Stefan Reuss, Rum (AT); David J. Dodge, Williston, VT (US); Ryan Coulter, Morristown, VT (US); Markus Koller, Innsbruck (AT); James D. Laughlin, Burlington, VT (US); Brian West, Burlington, VT (US) --

Item [57], ABSTRACT, should read as follows:
-- A highback for controlling a gliding board, such as a snowboard, through leg movement of a rider. The highback is comprised of at least two distinct materials with different stiffnesses to achieve a desired blend of stiffness and flexibility. The highback may employ a material of greater stiffness in one or more regions to provide high force transmission between the rider and the board. The highback may employ a material of lesser stiffness in one or more regions where flexibility is desired for more gradual power transmission, comfort and/or to facilitate highback adjustability. The arrangement of the different materials provides a lightweight highback with a relatively sleek profile having selected regions of stiffness and/or flexibility. --

Column 11,
Line 20, replace "33" with -- 35 --.

Signed and Sealed this

Fourth Day of November, 2003

JAMES E. ROGAN
*Director of the United States Patent and Trademark Office*